US008931418B2

(12) United States Patent
Matsuoka et al.

(10) Patent No.: US 8,931,418 B2
(45) Date of Patent: Jan. 13, 2015

(54) BODYSHELL STRUCTURE OF RAILCAR

(75) Inventors: Masayasu Matsuoka, Osaka (JP); Hiroyuki Kido, Osaka (JP); Taro Hayashi, Osaka (JP); Makoto Taguchi, Kobe (JP); Toshiyuki Yamada, Kobe (JP); Naoaki Kawakami, Kobe (JP); Yasufumi Minamimoto, Kobe (JP); Akira Ukita, Kobe (JP); Masami Hayashida, Kobe (JP)

(73) Assignees: West Japan Railway Company, Osaka (JP); Kawasaki Jukogyo Kabushiki Kaisha, Kobe (JP)

( * ) Notice: Subject to any disclaimer, the term of this patent is extended or adjusted under 35 U.S.C. 154(b) by 323 days.

(21) Appl. No.: 13/390,617

(22) PCT Filed: Apr. 21, 2010

(86) PCT No.: PCT/JP2010/002868
§ 371 (c)(1),
(2), (4) Date: Apr. 19, 2012

(87) PCT Pub. No.: WO2011/021323
PCT Pub. Date: Feb. 24, 2011

(65) Prior Publication Data

US 2012/0199043 A1 Aug. 9, 2012

(30) Foreign Application Priority Data

Aug. 19, 2009 (JP) ..... 2009-189656
Feb. 10, 2010 (JP) ..... 2010-027274

(51) Int. Cl.

| | |
|---|---|
| ***B61D 17/00*** | (2006.01) |
| ***B61D 17/04*** | (2006.01) |
| ***B61D 15/06*** | (2006.01) |
| ***B61D 17/06*** | (2006.01) |
| ***B61D 17/08*** | (2006.01) |

(52) U.S. Cl.
CPC ..... *B61D 17/043* (2013.01); *B61D 15/06* (2013.01); *B61D 17/06* (2013.01); *B61D 17/08* (2013.01)
USPC ..... 105/410

(58) Field of Classification Search
CPC ..... B61D 15/00; B61D 17/00; B61D 17/04; B61D 25/00
USPC ..... 105/396, 402, 410, 411, 420, 421
See application file for complete search history.

(56) References Cited

U.S. PATENT DOCUMENTS 3,791,312 A * 2/1974 Snyder et al. ..... 105/423
2008/0060544 A1 3/2008 Kawasaki et al.

FOREIGN PATENT DOCUMENTS

CN 101468649 A 7/2009
JP Y1-43-17292 7/1968

(Continued)

OTHER PUBLICATIONS

Jul. 20, 2010 International Search Report issued in International Patent Application No. PCT/JP2010/002868 (with translation).

*Primary Examiner* — R. J. McCarry, Jr.
(74) *Attorney, Agent, or Firm* — Oliff PLC

(57) ABSTRACT

A bodyshell of a railcar includes side outside plates, end bodyshells, and guiding plates. The side outside plate are located at both end portions of a carbody in a vehicle width direction. The end bodyshell includes an end outside plate and a corner post. The end outside plates are located at both end portions of the carbody in the longitudinal direction. The corner posts are located at four corners of the carbody. The corner post is joined to the adjacent end outside plate and the adjacent side outside plate. The guiding plate is provided at the side outside plate so as to cover the corner post from a vehicle exterior. The guiding plate includes an inclined portion and a joining portion. The inclined portion is provided in front of the corner post and inclined to the rear side toward the side outside plate.

6 Claims, 8 Drawing Sheets

(56) References Cited

FOREIGN PATENT DOCUMENTS

| | | |
|---|---|---|
| JP | U-53-113512 | 9/1978 |
| JP | A-56-138054 | 10/1981 |
| JP | A-2004-196170 | 7/2004 |
| JP | A-2004-276724 | 10/2004 |
| JP | B2-3955807 | 8/2007 |
| JP | A-2008-62817 | 3/2008 |
| JP | A-2008-201313 | 9/2008 |

* cited by examiner (a)

(b)

(a)

(b)

(a)

(b)

BODYSHELL STRUCTURE OF RAILCAR

TECHNICAL FIELD

The present invention relates to a bodyshell structure of a vehicle, such as a railcar, and particularly to a bodyshell structure of a railcar configured to have countermeasures to absorb the shock of an offset collision.

BACKGROUND ART

The offset collision denotes that in a case where two railcars 31 and 32 are running in directions opposite to each other, one vehicle (hereinafter may be referred to as an "oncoming vehicle") 31 derails from a track and collides with a part of the other vehicle (hereinafter may be referred to as a "running vehicle") 32 as shown in FIG. 8. Various countermeasures against the offset collision are being taken in railcars. As one example of the countermeasure against the offset collision, it is effective to configure a side bodyshell by using a double skin structure as in PTLs 1 and 2 to improve the stiffness of the side bodyshell or form an inclined surface at a front end portion of the side bodyshell of each of the vehicles 31 and 32 such that the vehicles 31 and 32 separate from each other at the time of the collision.

CITATION LIST

Patent Literature

PTL 1: Japanese Patent No. 3955807 (paragraph [0012] to [0014] and FIG. 4)

PTL 2: Japanese Laid-Open Patent Application Publication No. 2008-201313 (see FIGS. 3 and 6)

SUMMARY OF INVENTION

Technical Problem

The above-described double skin structure is applied to an aluminum alloy vehicle using aluminum alloy which is comparatively light in specific weight. Since a stainless steel vehicle using stainless steel which is heavy in specific weight than the aluminum alloy is heavy in weight, a single skin structure is commonly applied to the stainless steel vehicle. In order to facilitate steps of manufacturing the bodyshell of the single skin structure, an end outside plate to which corner posts have been joined in advance is attached to an underframe, and side outside plates are then attached to the underframe. At this time, a front end portion of the side outside plate is attached to the corner post so as to overlap the corner post from an outer side. Therefore, the front end portion of the side outside plate is exposed to the outside. As above, since the front end portion of the side outside plate is exposed to the outside, the front end portion of the side outside plate may be hooked at the time of the offset collision of the running vehicle 32, and the running vehicle 32 may keeps on running with the front end portion hooked. As a result, the side outside plate may be peeled off from the corner post.

Moreover, in the case of the single skin structure, unlike the double skin structure, the side outside plate and the corner post cannot be subjected to continuous welding by being placed face to face, and for example, the side outside plate needs to be welded to the corner post by spot welding. To be specific, the side outside plate and the corner post are joined to each other only by spots. Therefore, the problem is that as compared to the aluminum alloy vehicle disclosed in PTLs 1 and 2, the side outside plate of the stainless steel vehicle may be peeled at the time of the offset collision.

This problem seems to be a problem specific to the stainless steel vehicle to which the single skin structure is applied. However, the same problem occurs in the aluminum alloy vehicle if the side outside plate and the corner post overlap and are welded to each other and front and rear end portions of the side outside plate are exposed to the outside.

An object of the present invention is to provide a bodyshell structure of a railcar which has improved its safety against the offset collision.

Solution to Problem

A bodyshell structure of a railcar of the present invention includes: side outside plates respectively located at both end portions of a vehicle body in a vehicle width direction; an end bodyshell including end outside plates respectively located at both end portions of the vehicle body in a longitudinal direction and corner posts respectively located at four corners of the vehicle body and each joined to the adjacent side outside plate and the adjacent end outside plate; and a guide member located on an outer side of the corner post in the longitudinal direction and the vehicle width direction, wherein the guide member includes an inclined portion located in front of the end outside plate and on the outer side of the corner post in the longitudinal direction and inclined to an inner side in the longitudinal direction toward the side outside plate and a covering portion connected to the inclined portion, extending in the longitudinal direction, and covering a front end portion of the side outside plate.

In accordance with the present invention, since the covering portion of the guide member covers the front end portion of the side outside plate from the outer side in the vehicle width direction, and the inclined portion is located on the outer side of the front end portion of the side outside plate in the outer longitudinal direction, the front end portion of the side outside plate is located on the inner side of the guide member. Therefore, the oncoming vehicle does not directly hit the front end portion of the side outside plate at the time of the offset collision, and the oncoming vehicle can be prevented from hooking the front end portion of the side outside plate to peel off the side outside plate from the corner post.

Moreover, in the present invention, since the inclined portion of the guide member is inclined, the inclined portion can relatively fend off the oncoming vehicle in a direction away from its own vehicle at the time of the offset collision. With this, the collision load received by the vehicle can be suppressed, and a shear force applied in the front-rear direction at the time of the collision to a joining portion where the side outside plate and the corner post are joined to each other can be suppressed. Moreover, the shear force is suppressed by transferring a part of the collision load to the vehicle width direction by the inclined portion. As above, by suppressing the shear force, it is possible to prevent the side outside plate from being peeled off from the corner post. Further, the guide member presses the side outside plate against the corner post by the transferred force in the vehicle width direction. Therefore, the peel-off of the side outside plate from the corner post can be suppressed.

As above, in accordance with the bodyshell structure of the railcar of the present invention, the peel-off of the side outside plate from the corner post can be further suppressed, so that safety further improves.

Advantageous Effects of Invention

The present invention can provide a railcar which has further improved its safety against the offset collision.

BRIEF DESCRIPTION OF DRAWINGS

FIG. 1 is a front view of a bodyshell of a railcar of Embodiment 1 according to the present invention when viewed from the front.

FIG. 2(*b*) is an enlarged cross-sectional view taken along line C-C of FIG. 2(*a*) and shows the part of the bodyshell.

FIG. 3(*b*) is an enlarged cross-sectional view taken along line D-D of FIG. 3(*a*) and shows the part of the bodyshell.

FIG. 4 is a front view of the bodyshell of the railcar of Embodiments 2 to 4 of the present invention.

FIG. 5(*b*) is an enlarged view of the part of the bodyshell when viewed from a direction indicated by an arrow F of FIG. 5(*a*).

FIG. 6 is an enlarged cross-sectional view taken along line E-E of FIG. 4 and shows a part of the bodyshell of the railcar of Embodiment 3.

FIG. 7(*b*) is an enlarged view of the part of the bodyshell when viewed from a direction indicated by an arrow G of FIG. 7(*a*).

FIG. 8(*a*) is a plan view showing the railcars at the time of the offset collision when viewed from above, and FIG. 8(*b*) is a diagram showing the railcars at the time of the offset collision when viewed from a side surface.

DESCRIPTION OF EMBODIMENTS

Hereinafter, bodyshells 1 and 1A to 1C of railcars of Embodiments 1 to 4 according to the present invention will be explained in reference to the drawings. A concept of directions described in respective embodiments corresponds to a concept of directions when a running direction of the railcar is defined as a front direction. Here, a vehicle front-rear direction corresponds to a vehicle longitudinal direction (hereinafter simply referred to as a "longitudinal direction") indicating two directions. Among the two directions, an outer side direction of the longitudinal direction corresponds to a direction from a vehicle interior to a vehicle exterior, and an inner side direction of the longitudinal direction corresponds to a direction from the vehicle exterior to the vehicle interior. A vehicle left-right direction corresponds to a vehicle width direction (hereinafter simply referred to as a "vehicle width direction") indicating two directions. Among the two directions, an outer side direction of the vehicle width direction corresponds to a direction from the vehicle interior to the vehicle exterior, and an inner side direction of the vehicle width direction corresponds to a direction from the vehicle exterior to the vehicle interior. Each of the bodyshells 1 and 1A to 1C of the railcars explained below is just one embodiment of the present invention. The present invention is not limited to the embodiments below. Additions, eliminations, and modifications may be made within the spirit of the present invention.

Embodiment 1

Figure 1:
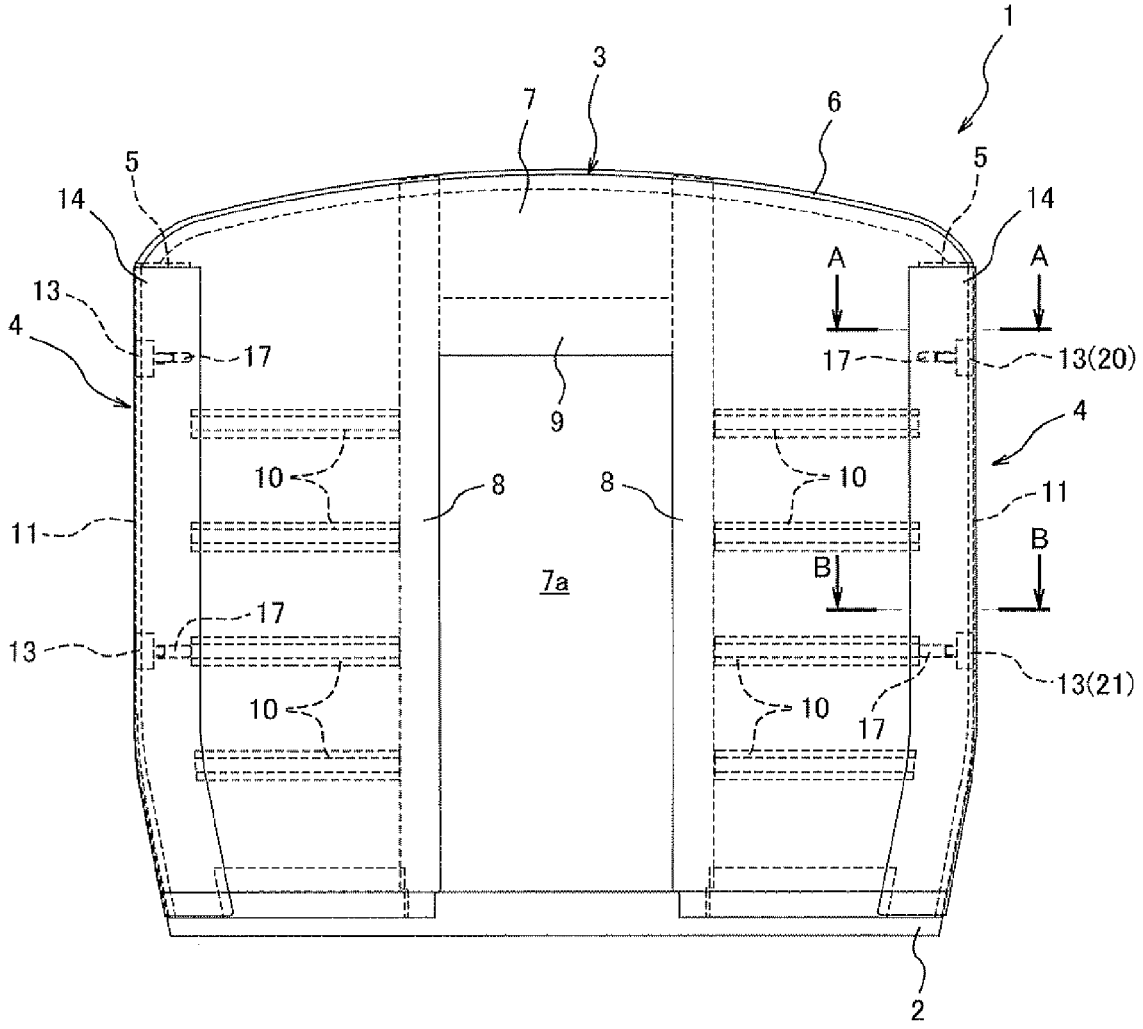
[FIG. 1]

In the railcar, a plurality of vehicles are coupled to one another, and intermediate vehicles are included between a first vehicle and a last vehicle. Each vehicle includes two trucks (not shown) each configured to be capable of running on a track. In each vehicle, these two trucks are positioned to be spaced apart from each other in a longitudinal direction, and the bodyshell 1 is mounted on the trucks via air springs, not shown. The bodyshell 1 has a substantially hollow rectangular solid shape, that is, a box shape, and a space for accommodating passengers or cargoes is formed in the bodyshell 1. As shown in FIG. 1, the bodyshell 1 includes an underframe 2 at its bottom portion.

Underframe

The underframe 2 has a substantially rectangular shape in plan view and is mounted on the two trucks. Side bodyshells 4 (see FIG. 2) respectively stand on both left and right end portions of the underframe 2, and end bodyshells 3 respectively stand on both front and rear end portions of the underframe 2. To be specific, the end bodyshells 3 are respectively positioned at both end portions in the longitudinal direction, and the side bodyshells 4 are respectively positioned at both end portions in the vehicle width direction. The end bodyshell 3 and the side bodyshell 4 adjacent to each other are connected to each other by a below-described corner post 5. Then, a roof bodyshell, not shown, is placed on the side bodyshells 4 and the end bodyshells 3. Thus, the underframe 2, the two side bodyshells 4, the two end bodyshells 3, and the roof bodyshell constitute the bodyshell 1 having the box shape.

Side Bodyshell

Figure 2:
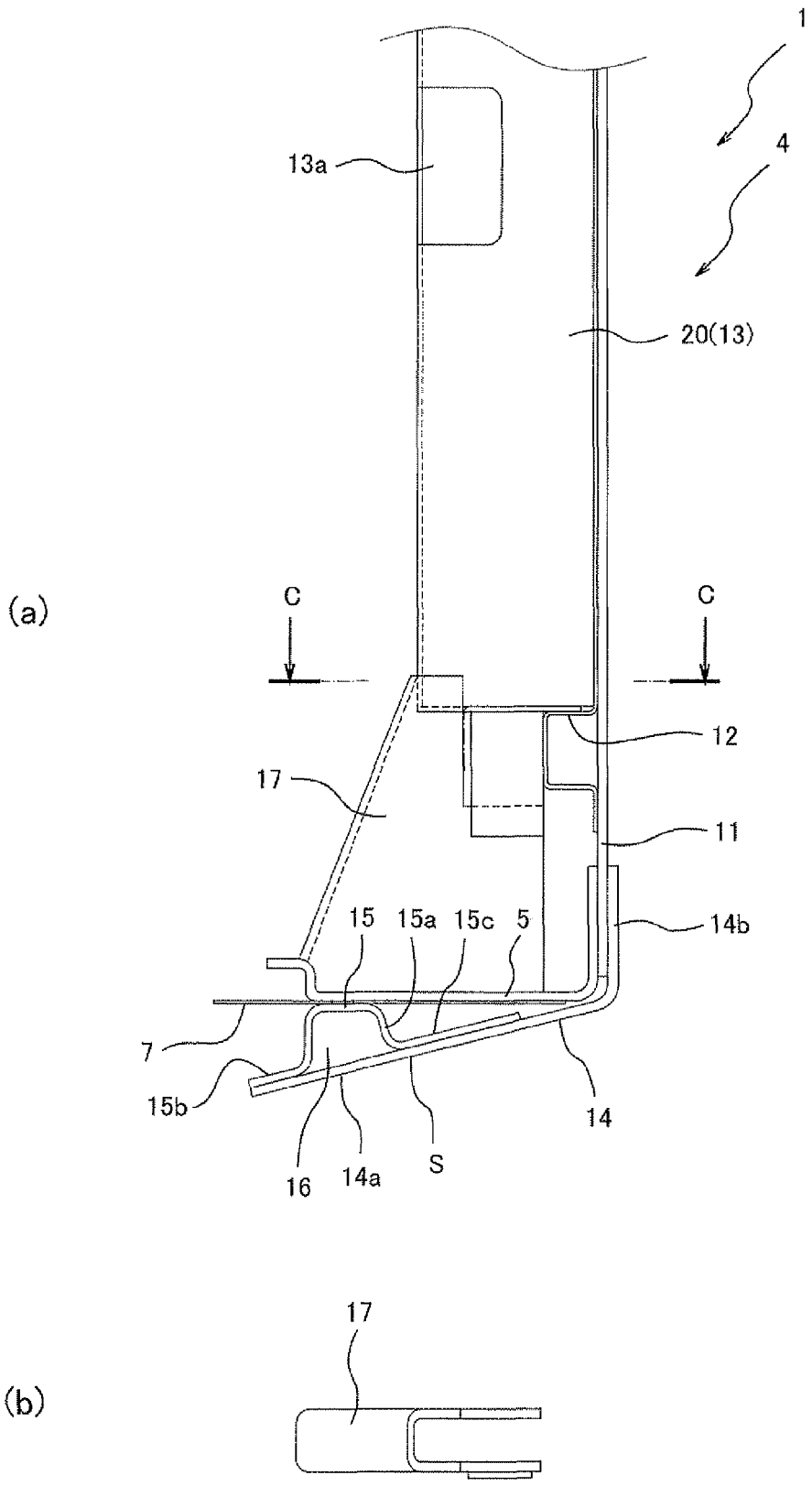
[FIGS. 2(*a*) and 2(*b*)] FIG. 2(*a*) is an enlarged cross-sectional view taken along line A-A of FIG. 1 and shows a part of the bodyshell.

As shown in FIGS. 1 and 2, the side bodyshell 4 includes a side outside plate 11, a plurality of side posts 12, and a plurality of side longitudinal members 13. In a side view when viewed from a left side or a right side, the side outside plate 11 is a plate member which has substantially a long rectangular solid shape in a front-rear direction. In a front view, a lower portion of the side outside plate 11 is bent toward an inner side. A lower end of the side outside plate 11 is joined to the underframe 2, and an upper end thereof extends up to the roof bodyshell. A plurality of windows (not shown) are formed on the side outside plate 11 at intervals in the front-rear direction. The plurality of side posts 12 and the plurality of side longitudinal members 13 are fixed to the inner side of the side outside plate 11 so as to avoid the windows. The side post 12 is provided between the windows so as to extend vertically. The side longitudinal member 13 is provided between two side posts 12 provided as above. The side longitudinal member 13 is a frame member, such as a window head or a window sill, and extends in the front-rear direction. In the present embodiment, three side longitudinal members 13 are provided below the window, and one side longitudinal member 13 is provided above the window. The number of side longitudinal members 13 and the positions of the side longitudinal members 13 are not limited to the above number and positions.

End Bodyshell

The end bodyshell 3 includes an end outside plate 7, gangway posts 8, a door header 9, crosspiece members 10, an arched girder 6, and the corner posts 5. In a front view when viewed from the front, the end outside plate 7 is a plate member having a substantially inverted U shape and stands on the underframe 2. An upper end of the end outside plate 7 extends up to the arched girder 6, and a space located at a horizontally center portion of the end outside plate 7 forms a gangway 7*a*. The gangway posts 8 respectively stand on both sides of the gangway 7*a* along the gangway 7*a*, and the door header 9 is provided on an upper side of the gangway 7*a*. The gangway post 8 extends from the underframe 2 up to the arched girder 6, and the door header 9 extends horizontally so as to connect the two gangway posts 8. Moreover, a plurality of crosspiece members 10 having a hat-shaped cross section are provided on the inner side of the end outside plate 7 and on an outer side of the gangway post 8. The crosspiece members 10 extend in the left-right direction and are attached to the end outside plate 7 at intervals in a vertical direction.

Corner Post

A pair of corner posts 5 are provided at each of both front and rear end portions of the underframe 2. To be specific, the corner posts 5 are respectively provided at four corners of a carbody. As described above, the pair of corner posts 5 constitute a part of the end bodyshell 3. As shown in FIGS. 1 and 2, the pair of corner posts 5 are respectively jointed to a left end portion and right end portion of the end outside plate 7 adjacent to the pair of corner posts 5. Moreover, the pair of corner posts 5 are respectively joined to the adjacent side outside plates 11 to connect the adjacent end outside plate 7 and the adjacent side outside plates 11. The corner post 5 configured as above is a substantially L-shaped plate member, and a portion thereof extending in the left-right direction is joined to an inner surface of the end outside plate 7 and a portion thereof extending in the front-rear direction is joined to an inner surface of the side outside plate 11. Moreover, the corner post 5 extends in the vertical direction, and a lower end thereof reaches the underframe 2 and an upper end thereof reaches the arched girder 6.

Guiding Plate

Figure 3:
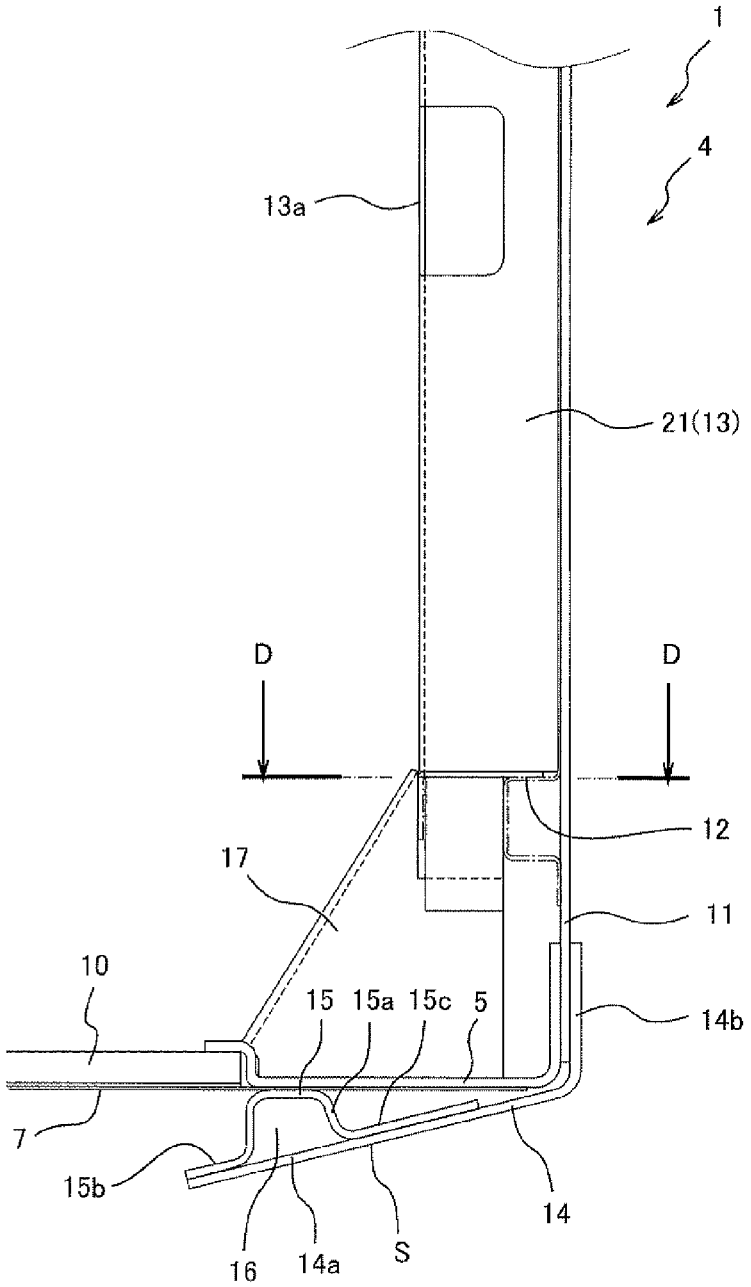
[FIGS. 3(*a*) and 3(*b*)] FIG. 3(*a*) is an enlarged cross-sectional view taken along line B-B of FIG. 1 and shows a part of the bodyshell.
Figure 3:
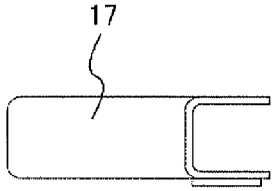

Moreover, the bodyshell 1 includes a guiding plate 14. The guiding plate 14 that is a guide member extends in the vertical direction and is provided at each of the corner posts 5. The guiding plate 14 is provided on the outer side of the corner post 5 and covers the corner post 5 from the vehicle exterior. The railcar inverts its running direction in an outward route and a return route. Therefore, two corner posts 5 located on a rear side in the outward route are located on a front side in the return route. Therefore, in order to take the countermeasure against the offset collision in both the outward route and the return route, the guiding plates 14 having the same shape are provided to realize front-rear symmetry and left-right symmetry. The following will explain the configurations of the guiding plates 14 respectively covering the pair of corner post 5 provided on the front side, and explanations of the configurations of two guiding plates 14 provided on the rear side to realize the front-rear symmetry with the guiding plates 14 provided on the front side are omitted. FIGS. 2 and 3 show the vicinity of the corner post 5 provided at the left corner on the front side.

The guiding plate 14 is a substantially L-shaped plate member extending in the vertical direction and includes an inclined portion 14*a* and a joining portion 14*b*. The inclined portion 14*a* is a plate member extending in the substantially left-right direction (that is, the vehicle width direction). The inclined portion 14*a* is provided in front of the corner post 5 (that is, on the outer side in the longitudinal direction) so as to cover the entire front surface of the corner post 5. The inclined portion 14*a* is inclined toward the side outside plate 11 (that is, toward the outer side in the vehicle width direction) and the rear side (that is, the inner side in the longitudinal direction). Thus, the inclined portion 14*a* includes an inclined surface S extending in the vehicle width direction so as to cover the entire front surface of the corner post 5 and inclined toward the side outside plate 11 and the rear side (that is, the inner side in the longitudinal direction). Moreover, the joining portion 14*b* is connected to an end portion of the inclined portion 14*a* on the outer side in the vehicle width direction. The joining portion 14*b* that is a covering portion of the guide member has a substantially flat plate shape and extends from the outer end portion of the inclined portion 14*a* to the rear side (that is, the inner side in the longitudinal direction). The joining portion 14*b* except for a lower end part thereof overlaps a front end portion of the side outside plate 11 from the outer side. Here, the side outside plate 11 and the corner post 5 are joined to each other by spot welding, and the guiding plate 14 and the side outside plate 11 are joined to each other by plug welding. With this, the front end portion of the side outside plate 11 is sandwiched between the guiding plate 14 and the corner post 5 and is located on the inner side of the guiding plate 14.

Figure 8:
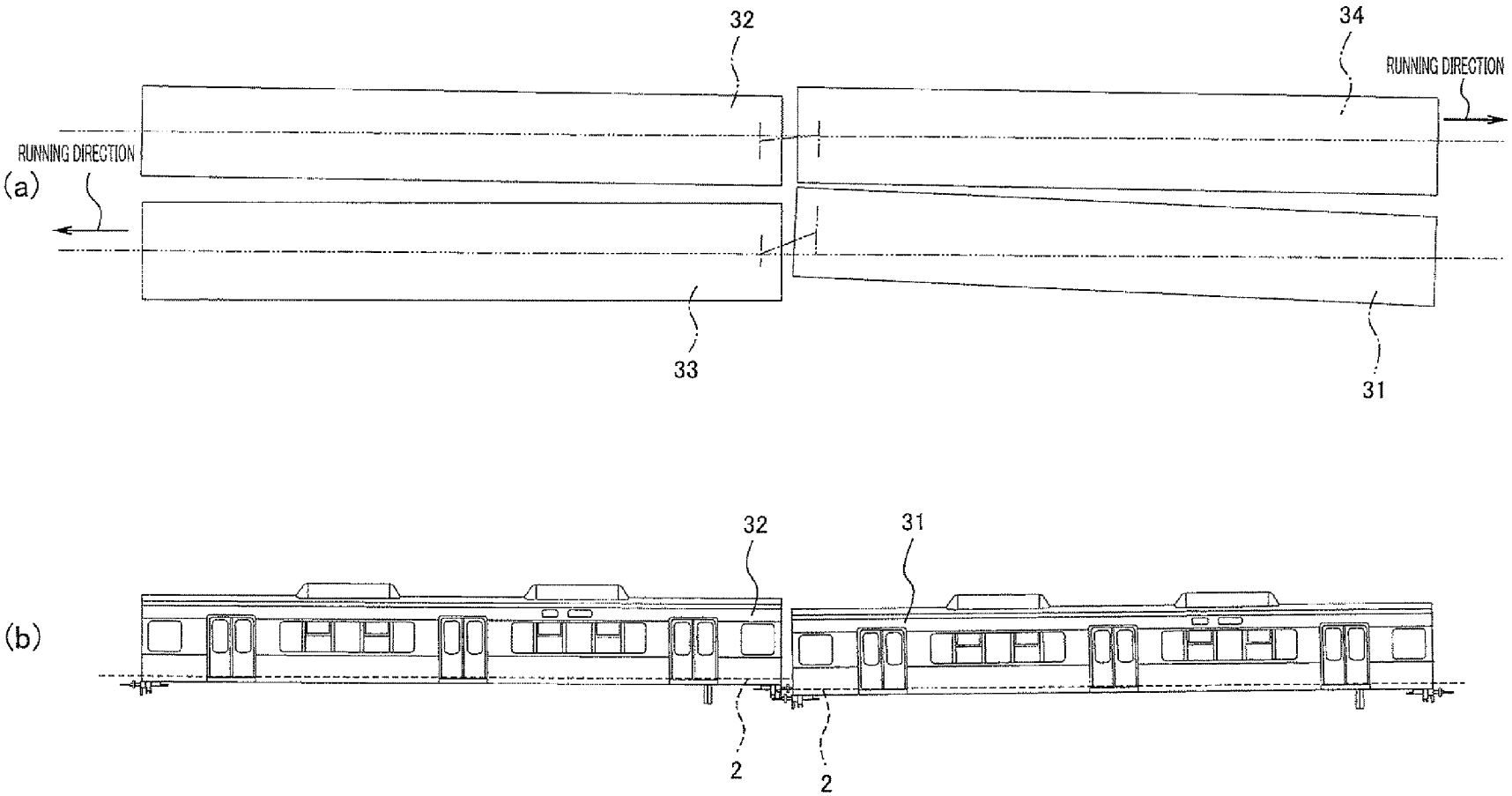
[FIGS. 8(*a*) and 8(*b*)] FIGS. 8(*a*) and 8(*b*) are diagrams showing a state where the offset collision of two railcars running in directions opposite to each other has occurred.

The gradient of the inclined surface S of the inclined portion 14*a* is set such that when a vehicle in front of the bodyshell 1 (hereinafter may be simply referred to as a "front vehicle"; see reference sign 33 in FIG. 8) yaws to the left and right, the inclined portion 14*a* of the bodyshell 1 and the inclined portion 14*a* of the front vehicle do not contact each other. Moreover, it is preferable that the width of the inclined surface S be such a width or wider that even if the front vehicle maximally yaws, only the inclined surface S is exposed to the front side and the end outside plate 7 is positioned behind the front vehicle and the inclined surface S.

A guiding plate supporting member 15 is provided on a rear surface of the guiding plate 14 configured as above. The guiding plate supporting member 15 is a plate member formed to have a hat-shaped cross section in plan view and extends in the vertical direction. The guiding plate supporting member 15 includes a main body portion 15*a* and two flange portions 15*b* and 15*c*. The main body portion 15*a* has a substantially U shape and is joined to a front surface of the end outside plate 7 with an opening thereof facing the guiding plate 14. Two flange portions 15*b* and 15*c* are connected to both end portions of the main body portion 15*a* and extend therefrom along the inclined portion 14*a* toward the outer side. These two flange portions 15*b* and 15*c* extending as above are joined to the rear surface of the inclined surface S, that is, the rear surface of the inclined portion 14*a*. The guiding plate supporting member 15 is provided on a tip end portion of the inclined portion 14*a*. The guiding plate supporting member 15 attached as above is interposed between the inclined portion 14*a* and the end outside plate 7 and supports the guiding plate 14 from the rear side. The guiding plate supporting member 15 and the inclined portion 14*a* constitute a closed cross-section structure including a closed space 16. With this, the stiffness of the guiding plate 14 improves, and the deformation of the guiding plate 14 is suppressed. In order to further improve the stiffness of the guiding plate 14, a plurality of corner post supporting members 17 are joined to the rear surface of the corner post 5.

Corner Post Supporting Member

The corner post supporting member 17 is a substantially hollow plate member. As shown in FIGS. 2(*b*) and 3(*b*), the corner post supporting member 17 has a U-shaped vertical cross section. The corner post supporting member 17 is provided between the corner post 5 and the side longitudinal member 13 such that an opening thereof faces the side outside plate 11. A front end of the corner post supporting member 17 is joined to a rear surface of the corner post 5, and a rear end thereof is joined to the side longitudinal member 13. In the present embodiment, two corner post supporting members 17 are provided so as to correspond to a window head 20 (see FIG. 2) and a window sill 21 (see FIG. 3) that are the side longitudinal members 13, and these two corner post supporting members 17 are respectively joined to the window head 20 and the window sill 21. As above, the corner post supporting member 17 is interposed between the guiding plate supporting member 15 and the side longitudinal member 13 and supports the corner post 5 from the rear side (that is, the inner side in the longitudinal direction). An inner side surface of the corner post supporting member 17 in the vehicle width direction is inclined in the outer vehicle width direction from the corner post 5 to the side longitudinal member 13.

Other Configurations

Each of the window head 20 and the window sill 21 includes a fragile portion 13*a*. When the guiding plate supporting member 15 receives a large load, each of the window head 20 and the window sill 21 is bent toward the outer side in the vehicle width direction by the fragile portion 13*a*. To be specific, each of the window head 20 and the window sill 21 is bent such that the fragile portion 13*a* is pushed out toward the outer side in the vehicle width direction from a remaining portion. In the present embodiment, the fragile portion 13*a* is a cutout which opens to the inner side in the vehicle width direction and extends in the longitudinal direction. Moreover, the fragile portion 13*a* can be realized by locally reducing the stiffness of each of the window head 20 and the window sill 21, such as by reducing the thickness of a part of each of the window head 20 and the window sill 21.

Offset Collision

Hereinafter, a case where the offset collision of two vehicles 31 and 32 each including the bodyshell 1 has occurred will be explained in reference to FIGS. 2, 3, and 8. In a case where two vehicles 31 and 32 are running on the tracks in directions opposite to each other, one vehicle (hereinafter may be simply referred to as an "oncoming vehicle") 31 may derail from the track, and the offset collision of the oncoming vehicle 31 and the other vehicle (hereinafter may be simply referred to as a "running vehicle") 32 may occur. Front surfaces of both end portions of the end outside plates 7 of the vehicles 31 and 32 in the vehicle width direction and front surfaces of the corner posts 5 are covered with the guiding plates 14, and a remaining portion of the end outside plate 7 is positioned behind the front vehicle 33, 34 and the guiding plate 14. Therefore, in this offset collision, the end outside plate 7 and the corner post 5 do not collide with the other vehicle 31, 32. The guiding plates 14 of the vehicles 31 and 32 collide with each other (see FIG. 8(*a*)).

When the guiding plates 14 collide with each other, a predetermined collision load acts on the guiding plates 14. However, the guiding plate 14 is supported and reinforced from the rear side by the guiding plate supporting member 15 constituting the closed cross-section structure together with the guiding plate 14. Therefore, the stiffness of the guiding plate 14 improves, and the deformation of the guiding plate 14 at the time of the offset collision is suppressed. Moreover, the corner post 5 is supported and reinforced from the rear side by the corner post supporting members 17 respectively provided at the window head 20 and the window sill 21. Therefore, the stiffness of the corner post 5 improves as compared to the bodyshell of the conventional railcar, and the deformation of the corner post 5 at the time of the offset collision is suppressed.

After the guiding plate 14 of the oncoming vehicle 31 and the guiding plate 14 of the running vehicle 32 collide with each other, each of the vehicles 31 and 32 can fend off the other vehicle 32 or 31 by the inclined portion 14*a* in a direction away from its own vehicle. To be specific, the oncoming vehicle 31 is fended off by the inclined portion 14*a* of the running vehicle 32 in a direction away from the running vehicle 32, and the running vehicle 32 is fended off by the inclined portion 14*a* of the oncoming vehicle 31 in a direction away from the oncoming vehicle 31. By fending off each other, the collision load applied to each of the oncoming vehicle 31 and the running vehicle 32 can be suppressed, and a shear force applied at the time of the collision to a joining portion where the side outside plate 11 and the joining portion 14*b* are joined to each other can be suppressed. Moreover, the shear force is suppressed by transferring a part of the collision load to the vehicle width direction by the inclined portion 14*a*. As above, the inclined portion 14*a* suppresses the shear force applied to the joining portion to prevent the side outside plate 11 from being peeled off from the corner post 5.

Further, by transferring the collision load to the vehicle width direction, the guiding plate 14 presses the front end portion of the side outside plate 11 against the corner post 5 by the transferred force. With this, the peel-off of the side outside plate 11 from the corner post 5 at the time of the collision is further suppressed. Moreover, since the side outside plate 11 is sandwiched between the joining portion 14*b* of the guiding plate 14 and the corner post 5, the side outside plate 11 is less likely to be peeled off from the corner post 5 and the guiding plate 14.

In order to obtain an effect of suppressing and preventing the peel-off, it is desirable that each of the oncoming vehicle 31 and the running vehicle 32 include the bodyshell 1. However, at least one of the oncoming vehicle 31 and the running vehicle 32 may include the bodyshell 1 of the present embodiment.

After the collision, the oncoming vehicle 31 and the running vehicle 32 are separated from each other by the inclined portion 14*a* up to a position where the guiding plate 14 of the oncoming vehicle 31 and the guiding plate 14 of the running vehicle 32 do not contact each other. Then, the vehicles 31 and 32 run in directions opposite to each other such that one of the vehicles 31 and 32 runs along the joining portion 14*b* of the other vehicle 31 or 32. The front end portion of the side outside plate 11 is provided on the inner side of the joining portion 14*b*. Therefore, each of the oncoming vehicle 31 and the running vehicle 32 does not directly hit the front end portion of the side outside plate 11 of the other vehicle. On this account, each of the oncoming vehicle 31 and the running vehicle 32 does not hook the side outside plate 11 of the other vehicle and does not peel off the side outside plate 11 from the corner post 5. As above, since the joining portion 14*b* overlaps the front end portion of the side outside plate 11 from the outer side, it is possible to prevent each of the oncoming vehicle 31 and the running vehicle 32 from hooking the front end portion of the side outside plate 11 and peeling off the side outside plate 11 from the corner post 5.

Moreover, at the time of the collision, the side longitudinal member 13 is bent toward the vehicle exterior by the fragile portion 13*a*. In this case, the front end portion of the side outside plate 11 inclines toward the vehicle interior to be further away from the oncoming vehicle 31. With this, the oncoming vehicle 31 is further less likely to hook the front end portion of the side outside plate 11. Thus, the peel-off of the front end portion of the side outside plate 11 from the corner post 5 by the oncoming vehicle 31 can be further suppressed.

Moreover, since the oncoming vehicle 31 which causes the offset collision derails, it collides with the running vehicle 32 from a position lower than the running vehicle 32 (see FIG.

8(*b*)). Therefore, at the time of the offset collision, the underframe 2 of the running vehicle 32 is higher in position than the underframe 2 of the oncoming vehicle 31. By extending the guiding plate 14 up to the vicinity of the vertically center portion of the underframe 2 (see FIG. 1), the underframe 2 having high stiffness is prevented from directly hitting the corner post 5 of the other vehicle. With this, the damage of the corner post 5 of the oncoming vehicle 31 at the time of the offset collision can be suppressed.

Embodiment 2

The configuration of a bodyshell 1A of the railcar of Embodiment 2 according to the present invention is similar to the configuration of the bodyshell 1 of the railcar of Embodiment 1. The following will explain only specific components of the bodyshell 1A of the railcar of Embodiment 2, and the same reference signs are used for the same components as the bodyshell 1 of the railcar of Embodiment 1 and explanations thereof are omitted.

Figure 4:
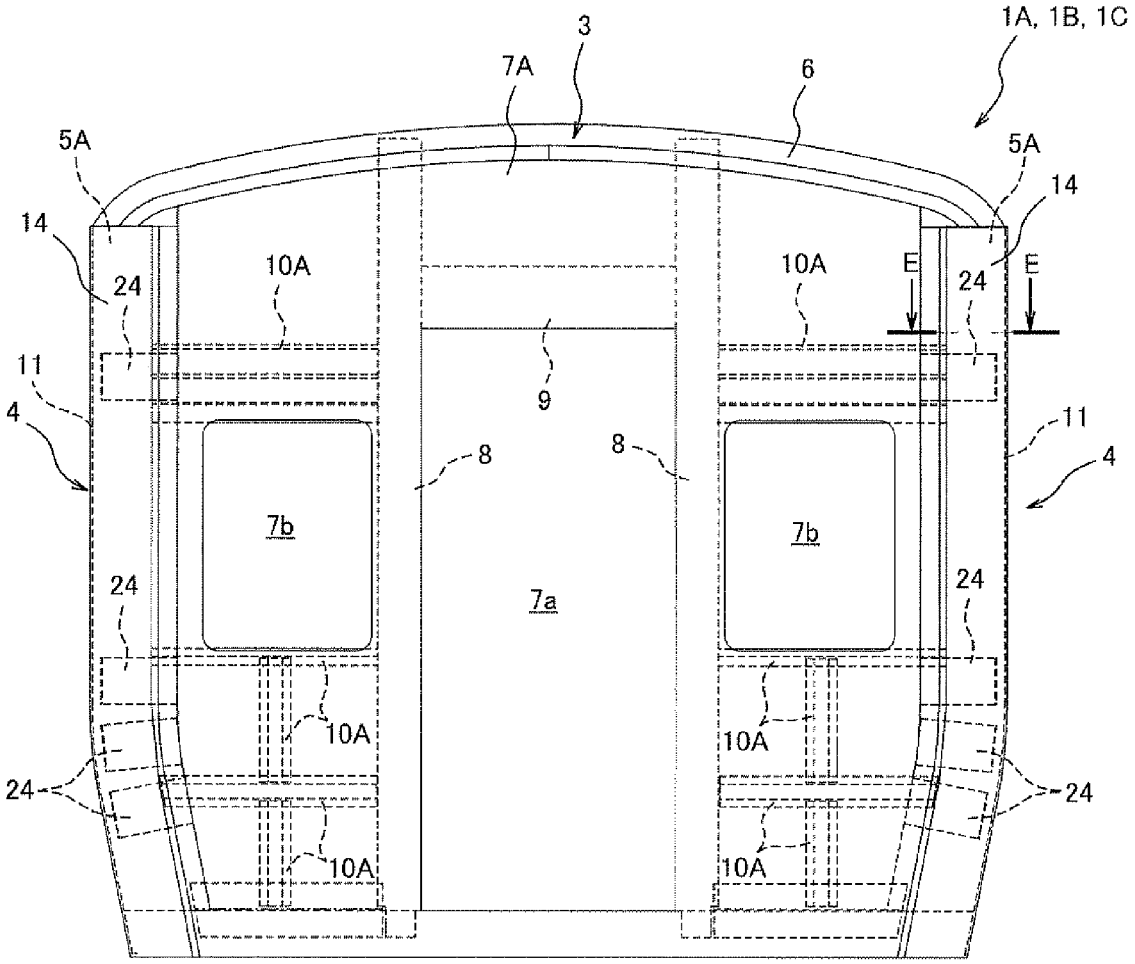
[FIG. 4]
Figure 5:
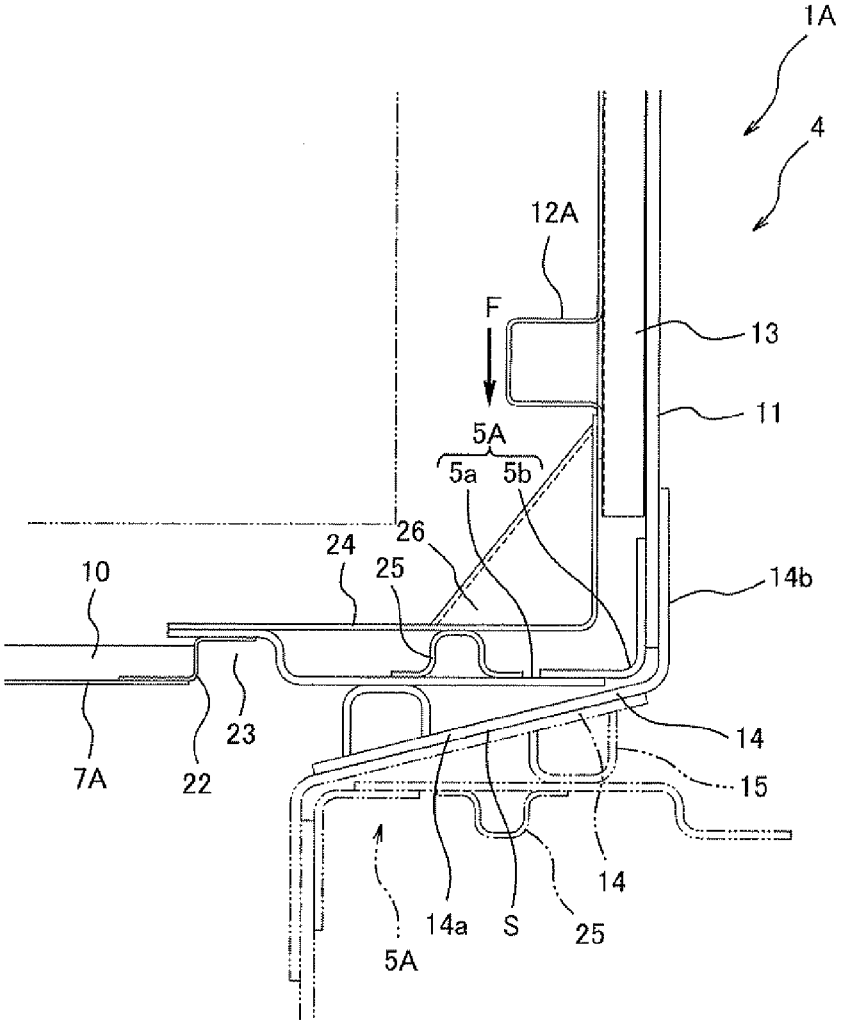
[FIGS. 5(*a*) and 5(*b*)] FIG. 5(*a*) is an enlarged cross-sectional view taken along line E-E of FIG. 4 and shows a part of the bodyshell of the railcar of Embodiment 2.
Figure 5:
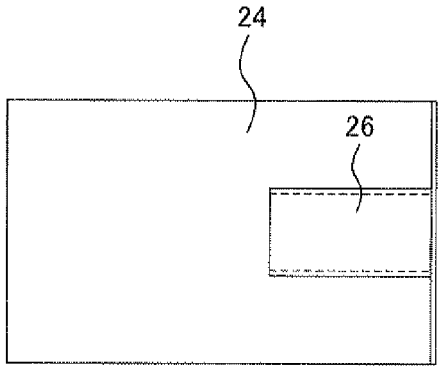

As shown in FIG. 4, in the bodyshell 1A of the railcar of Embodiment 2, windows 7*b* are formed on an end outside plate 7A, and crosspiece members 10A extend not only in the vehicle width direction but also in the vertical direction. As shown in FIG. 5(*a*), each of corner posts 5A respectively joined to both left and right end portions of the end outside plate 7A can be divided into a portion 5*a* extending in the left-right direction and joined to the end outside plate 7A and a portion 5*b* having one end joined to the portion 5*a* extending in the left-right direction and the other end extending in the front-rear direction and joined to the side outside plate 11. The corner post 5A is configured to be assembled by joining these two portions 5*a* and 5*b*. In the corner post 5A, the portion 5*a* extending in the left-right direction is constituted by so-called Z-steel, and an end portion thereof located on the end outside plate 7A side is positioned on the vehicle interior side of the end outside plate 7A. Both end portions of a receiving plate 22 that is Z-steel are respectively jointed to the end outside plate 7A and the corner post 5A. Thus, the end outside plate 7A and the corner post 5A are joined to each other via the receiving plate 22. In the present invention, the term "join" includes a case where two parts are indirectly joined to each other via, for example, the receiving plate 22. By such joining, a front-rear gap between the end outside plate 7A and the corner post 5A is filled by the receiving plate 22. Thus, a concave portion 23 is formed therebetween so as to extend in the vertical direction and be concave toward the rear side. The concave portion 23 serves as a counterbore in which a head of a bolt is accommodated when fastening the end outside plate 7A and the corner post 5A with the bolt.

By dividing the corner post 5A into two parts, the portion 5*b* extending in the front-rear direction and the portion 5*a* extending in the left right direction can be joined to each other after the end outside plate 7A and the side outside plate 11 are assembled to the underframe 2. Therefore, these two portions of the corner post 5A can be respectively joined to the side outside plate 11 and the end outside plate 7A in advance. Thus, the corner post 5A can be easily attached to the end outside plate 7A and the side outside plate 11.

Moreover, a plurality of side longitudinal members 13, each of which is lower in height (length in the vehicle width direction in the present embodiment) than each of the window head 20 and the window sill 21, are provided on the inner side of the side outside plate 11 at intervals in the vertical direction. A side post 12A is provided over these side longitudinal members 13. Moreover, each of the side longitudinal members 13 is provided with a supporting plate 24.

The supporting plate 24 that is a corner post supporting member has a substantially L shape and is provided on the vehicle interior side of the corner post 5A. In the supporting plate 24, a portion thereof extending in the front-rear direction is joined to a portion of the side longitudinal member 13 which portion is located in front of the side post 12A, that is, to the front end portion of the side longitudinal member 13, and a portion thereof extending in the left-right direction is joined to an end portion of the corner post 5A which portion is located on the end outside plate 7A side. A supporting member 25 is provided between the corner post 5A and the supporting plate 24. The supporting member 25 has a hat-shaped cross section. Both flanges 25*a* and 25*b* of the supporting member 25 is joined to the portion of the corner post 5A, the portion extending in the left-right direction. A web 25*c* of the supporting member 25 is joined to the supporting plate 24 and supports and reinforces the corner post 5A from the rear side. With this, crushing of the corner post 5A at the time of the collision can be suppressed, and fend-off by the guiding plate 14 can function even after the collision.

Further, the supporting plate 24 is provided with a reinforcing member 26 shown in FIGS. 5(*a*) and 5(*b*). The reinforcing member 26 is formed to have a substantially right angled triangle in plan view so as to correspond to the shape of a corner of the supporting plate 24. The reinforcing member 26 has a U-shaped cross section. The reinforcing member 26 is provided at a vehicle interior side corner of the supporting plate 24 such that two surfaces thereof perpendicular to each other in plan view open to the portion of the supporting plate 24 which portion extends in the left-right direction and the portion of the supporting plate 24 which portion extends in the front-rear direction. Each of these two surfaces of the reinforcing member 26 is joined to the portion of the supporting plate 24 which portion extends in the left-right direction and the portion of the supporting plate 24 which portion extends in the front-rear direction. The reinforcing member 26 provided as above reinforces the supporting plate 24 to prevent the supporting plate 24 from being crushed. With this, the crushing of the corner post 5A to the rear side together with the supporting plate 24 at the time of the collision can be suppressed, and the fend-off by the guiding plate 14 can function even after the collision.

In addition, the bodyshell 1A of the railcar of Embodiment 2 has the same operational advantages as the bodyshell 1 of the railcar of Embodiment 1.

Embodiment 3

The configuration of a bodyshell 1B of the railcar of Embodiment 3 according to the present invention is similar to the configuration of the bodyshell 1A of the railcar of Embodiment 2. The following will explain only specific components of the bodyshell 1B of the railcar of Embodiment 3, and the same reference signs are used for the same components as the bodyshell 1A of the railcar of Embodiment 2 and explanations thereof are omitted. The same is true for a bodyshell 1C of the railcar of Embodiment 4 described below.

Figure 6:
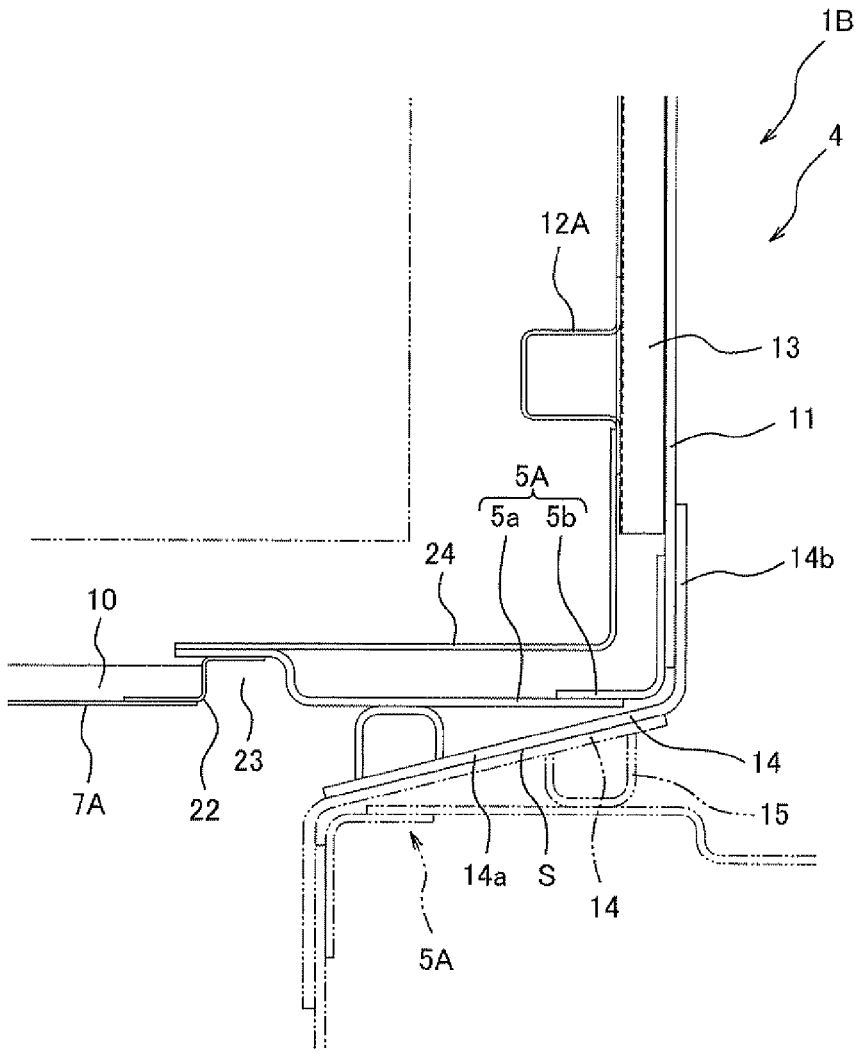
[FIG. 6]

As shown in FIG. 6, the bodyshell 1B of the railcar of Embodiment 3 according to the present invention does not include the supporting member 25 and reinforcing member 26 of the bodyshell 1A of the railcar of Embodiment 2. The supporting plate 24 constitutes the closed cross-section structure together with the corner post 5A to improve the stiffness of the corner post 5A. With this, the crushing of the corner post 5A can be suppressed, and the fend-off by the guiding plate 14 can function even after the collision.

In addition, the bodyshell 1B of the railcar of Embodiment 3 has the same operational advantages as the bodyshell 1 of the railcar of Embodiment 2.

Embodiment 4

Figure 7:
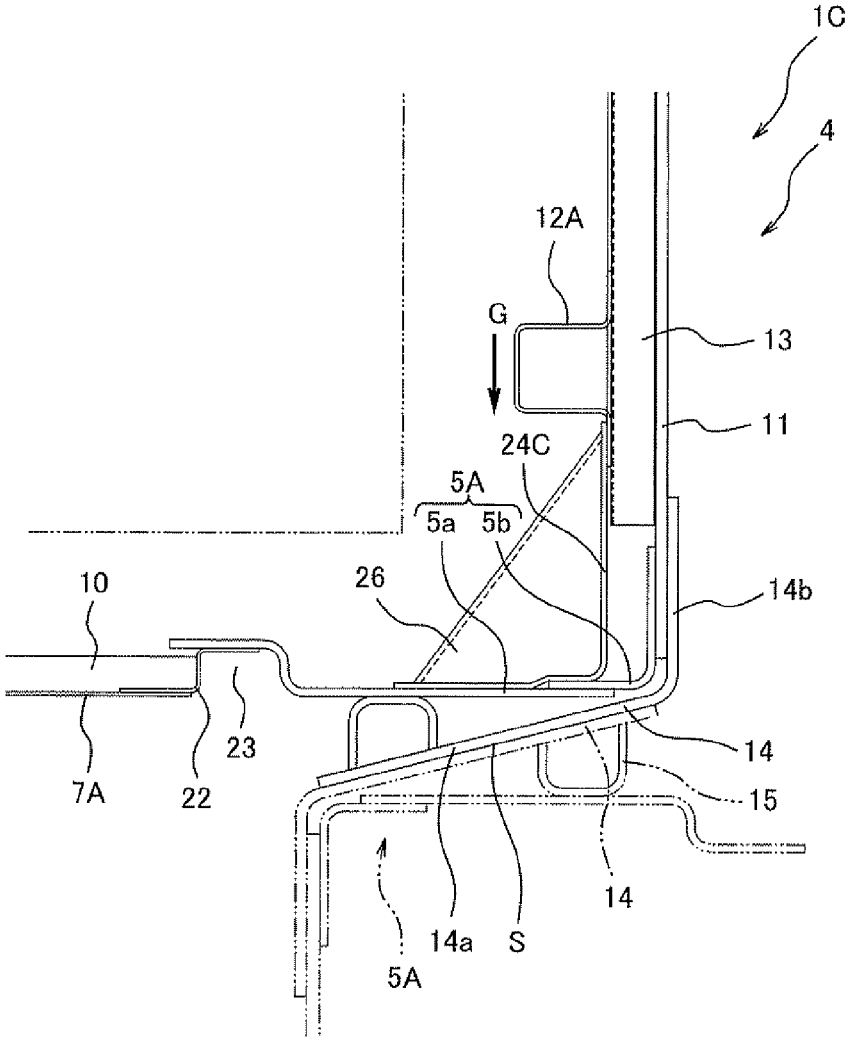
[FIGS. 7(*a*) and 7(*b*)] FIG. 7(*a*) is an enlarged cross-sectional view taken along line E-E of FIG. 4 and shows a part of the bodyshell of the railcar of Embodiment 4.
Figure 7:
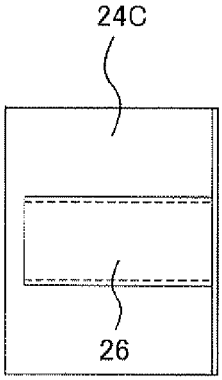

As shown in FIG. 7(*a*), in the bodyshell 1C of the railcar of Embodiment 4, a portion of a supporting plate 24C which portion extends in the left-right direction is joined to the portion of the corner post 5A which portion extends in the left-right direction. With this, the corner post 5A is supported and reinforced by the supporting plate 24C. Thus, the crushing of the corner post 5A can be suppressed, and the fend-off by the guiding plate 14 can function even after the collision.

Moreover, as shown in FIGS. 7(*a*) and 7(*b*), the supporting plate 24C is provided with the reinforcing member 26 as with the bodyshell 1B of Embodiment 3. Thus, the bending of the supporting plate 24C at the time of the collision is prevented, and the crushing of the corner post 5A to the rear side at the time of the collision together with the supporting plate 24C is suppressed. With this, the fend-off by the guiding plate 14 can function even after the collision.

Other Embodiment

In the present embodiment, the lower portion of each of the side bodyshell 4 and the corner posts 5 and 5A is bent toward the inner side. However, the lower portion may have a straight shape. Further, in the present embodiment, a plurality of side longitudinal members 13 are provided on the inner surface of the side outside plate 11 to reinforce the side outside plate 11. However, an inner plate on which a plurality of convex portions extending in the front-rear direction are formed may be provided on the inner side of the side outside plate 11 to reinforce the side outside plate 11. Moreover, the shape of the supporting member 25 is not limited to the above. The supporting member 25 may be a circular member or a solid member as long as the supporting member 25 can support the corner post 5 from the rear side. Then, the shape of each of the supporting plates 24 and 24C is not limited to the above. As with the corner post 5A, each of the supporting plates 24 and 24C may be a plate member extending from the underframe 2 to the arched girder 6. The same is true for the side post 12.

The bodyshell 1 of the present embodiment is applicable to not only a stainless steel vehicle to which the single skin structure is applied but also an aluminum alloy vehicle to which the double skin structure is applied, and the material of the vehicle does not matter. In addition, a joining method is not limited to the method of the present embodiment. Moreover, in the present embodiment, respective members are joined to one another by, for example, welding. However, the same operational advantages can be obtained even in a case where two members are joined to each other with fastening members, such as bolts.

INDUSTRIAL APPLICABILITY

The present invention relates to a bodyshell structure of a railcar. Especially, the present invention is applicable to a bodyshell structure of a railcar which requires countermeasures to absorb the shock of the offset collision.

REFERENCE SIGNS LIST

1, 1A to 1C railcar
2 underframe
5, 5A corner post
7, 7A end outside plate
11 side outside plate
13 side longitudinal member (frame member)
13*a* fragile portion
14 guiding plate
14*a* inclined portion
14*b* joining portion
15 guiding plate supporting member
17 corner post supporting member
20 window head
21 window sill
24, 24C supporting plate
25 supporting member
26 reinforcing member

The invention claimed is:

1. A bodyshell structure of a railcar having a vehicle body, the bodyshell structure comprising:

side outside plates respectively located at both end portions of the vehicle body in a vehicle width direction;

an end bodyshell including end outside plates respectively located at both end portions of the vehicle body in a longitudinal direction and corner posts respectively located at four corners of the vehicle body, each corner post being configured to join an adjacent side outside plate and an adjacent end outside plate; and a guide member located on an outer side of the corner post in the longitudinal direction and the vehicle width direction, the guide member including: (i) an inclined portion located in front of the end outside plate and located on the outer side of the corner post in the longitudinal direction, the inclined portion being configured to incline towards an inner side in the longitudinal direction toward the side outside plate, and (ii) a covering portion connected to the inclined portion, the covering portion being configured to extend in the longitudinal direction, and to cover a front end portion of the side outside plate.

2. The bodyshell structure according to claim 1, further comprising:

a guide supporting member located between the guide member and the corner post and supporting the guide member from the inner side in the longitudinal direction.

3. The bodyshell structure according to claim 1, wherein the guide member, the side outside plate, and the corner post are arranged in this order from an outer side to an inner side in the vehicle width direction and joined to one another.

4. The bodyshell structure according to claim 1, further comprising:

a frame member provided on an inner side of the side outside plate and extending in the longitudinal direction; and a corner post supporting member joined to the frame member and supporting the corner post from the inner side in the longitudinal direction.

5. The bodyshell structure according to claim 4, wherein the frame member includes a fragile portion that is a part of the frame member and is low in stiffness, and when receiving a shock in the longitudinal direction, the frame member is bent to an outer side in the vehicle width direction by the fragile portion.

6. The bodyshell structure according to claim 4, wherein the frame member is a window head or a window sill.

* * * * *